US005794482A

United States Patent [19]

Walkin

[11] Patent Number: 5,794,482

[45] Date of Patent: Aug. 18, 1998

[54] APPARATUS IN A HYDRAULIC PRESS

[75] Inventor: Bengt Walkin, Tranemo, Sweden

[73] Assignee: AP&T Tranemo AB, Tranemo, Sweden

[21] Appl. No.: 537,654

[22] PCT Filed: Apr. 11, 1994

[86] PCT No.: PCT/SE94/00316

§ 371 Date: May 2, 1996

§ 102(e) Date: May 2, 1996

[87] PCT Pub. No.: WO94/23862

PCT Pub. Date: Oct. 27, 1994

[30] Foreign Application Priority Data

Apr. 19, 1993 [SE] Sweden ..... 9301278-9

[51] Int. Cl.[6] ..... B21D 22/00; B21D 22/21

[52] U.S. Cl. ..... 72/350; 72/351

[58] Field of Search ..... 72/347, 350, 351, 72/352, 354.6, 379.4, 453.13; 267/119

[56] References Cited

U.S. PATENT DOCUMENTS

| | | | |
|---|---|---|---|
| 1,861,337 | 5/1931 | Ernst | 72/351 |
| 2,136,240 | 4/1936 | Ernst | 72/351 |
| 2,233,164 | 6/1938 | Glasner | 267/119 |
| 2,300,162 | 5/1938 | Maude | 72/351 |
| 2,333,529 | 8/1940 | Ernst | 267/119 |
| 3,202,411 | 8/1965 | Heiser | 72/351 |
| 5,339,665 | 8/1994 | Yoshikawa | 72/351 |

*Primary Examiner*—Lowell A. Larson
*Assistant Examiner*—Rodney Butler
*Attorney, Agent, or Firm*—Rader, Fishman, Grauer & McGarry

[57] ABSTRACT

A hydraulic press for deep drawing has mutually reciprocating clamping rings (6, 13) for idly clamping a sheet metal blank (5) with a predetermined force. The clamping rings (6, 13) are operated each by their cylinder (9, 14). The press has a tool (4) for forming the sheet blank (5), and a power unit (10, 11, 16) for generating a relative movement between, on the one hand, the clamping rings (6, 13) and, on the other hand, the tool (4). During the forming phase, the working volumes of the cylinders (9, 14) are interconnected to a common volume to which there is further connected a pressure maintenance device wit a pressure sensor (22), a regulator valve (23) and a pump (28). The piston areas of the cylinders (9, 14) are suitably equal.

23 Claims, 3 Drawing Sheets

APPARATUS IN A HYDRAULIC PRESS

TECHNICAL FIELD

The present invention relates to an apparatus in a hydraulic press for deep drawing, and comprises mutually reciprocating clamping members for fixedly clamping therebetween a sheet metal blank with a predetermined force; at least two counter-directed clamping cylinders connected with, and operating, each respective clamping member; a tool piece over which the sheet metal blank is formed; and a power unit which, for forming the sheet metal blank, is operative to realise a relative movement between, on the one hand, the tool piece, and, on the other hand, the clamping members.

BACKGROUND ART

Numerous different designs of hydraulic presses are previously known in the art for deep drawing of sheet material. In such presses, use is made of a locator ring and a clamping ring between which the sheet metal blank is fixedly clamped with a predetermined force. The thus fixedly retained sheet blank is displaced, together with the clamping ring and the locator ring, down over a tool, the sheet material being drawn radially inwards at the same time as it is formed over the tool.

The clamping ring is mounted on a movable slide which, as a rule, is operated by means of one or more cylinders. In order to realise a predetermined clamping force between the clamping ring and the locator ring so that the sheet metal blank can be held in the requisite manner and prevented from being buckled when it is drawn inwards towards the tool, the locator ring is suspended on a locator cylinder which strives to move the locator ring in a direction which is opposed to the direction of movement of the clamping ring. When the clamping ring is subsequently depressed, the locator ring is entrained in the movement against the action of the locator cylinder. In order that this is not ruptured, hydraulic fluid is released from the locator cylinder via a throttle which regulates that counterforce which the locator cylinder generates.

Displacement of the locator ring against that force which the locator cylinder generates entails a considerable work which in principle is equal to the product of the clamping force against the sheet metal blank and the stroke length of the movement of the locator ring. All of this work is throttled off in the pressure regulator throttle valve and is thereby lost. In many applications, there is inherent work which is lost in this manner, of the same order of magnitude or greater than the work which is required for the actual forming of the sheet metal blank.

PROBLEM STRUCTURE

The present invention has for its object to design the apparatus intimated by way of introduction such that it offers a possibility of substantially reducing the energy consumption in a hydraulic press for deep drawing. In particular, the present invention had for its object to design the apparatus so that the clamping of the sheet metal blank during the forming operation proper may take place without any substantial work being executed. The invention further has for its object to realise an apparatus which is simple and economical in manufacture and which affords high operational dependability.

SOLUTION

The objects forming the basis of the present invention will be attained if the apparatus intimated by way of introduction is characterized in that the working volumes of the clamping cylinders, at least during the forming phase proper, are interconnectable to a common volume; and that a pressure maintenance device is coupled to this volume for realising the predetermined clamping force.

Given that the two counter-directed clamping cylinders are interconnected in this way, they will not accomplish any actual work during their movement. That volume of hydraulic fluid which is forced aside out of the one cylinder flows over to the other cylinder to fill it. The only work which, in such instance, is accomplished is represented by friction and flow losses.

One preferred embodiment of the present invention is suitably characterized in that the total area of the clamping cylinders which act on each clamping member is substantially equal.

These features afford a design and construction which are particularly simple.

Further advantages will be attained according to the present invention if it is also given one or more of the characterizing features as set forth in appended claims 3 to 7.

BRIEF DESCRIPTION OF THE ACCOMPANYING DRAWINGS

The present invention will now be described in greater detail hereinbelow, with particular reference to the accompanying Drawings. In the accompanying Drawings:

FIG. 1 schematically illustrates a hydraulic press intended for deep drawing, in the starting position before an operational stroke;

FIG. 2 shows the hydraulic press according to FIG. 1 in which the slide has been lowered into contact with the workpiece; and FIG. 3 shows the press of FIGS. 1 and 2 after a completed operational stroke.

DESCRIPTION OF PREFERRED EMBODIMENT

Figure 1:
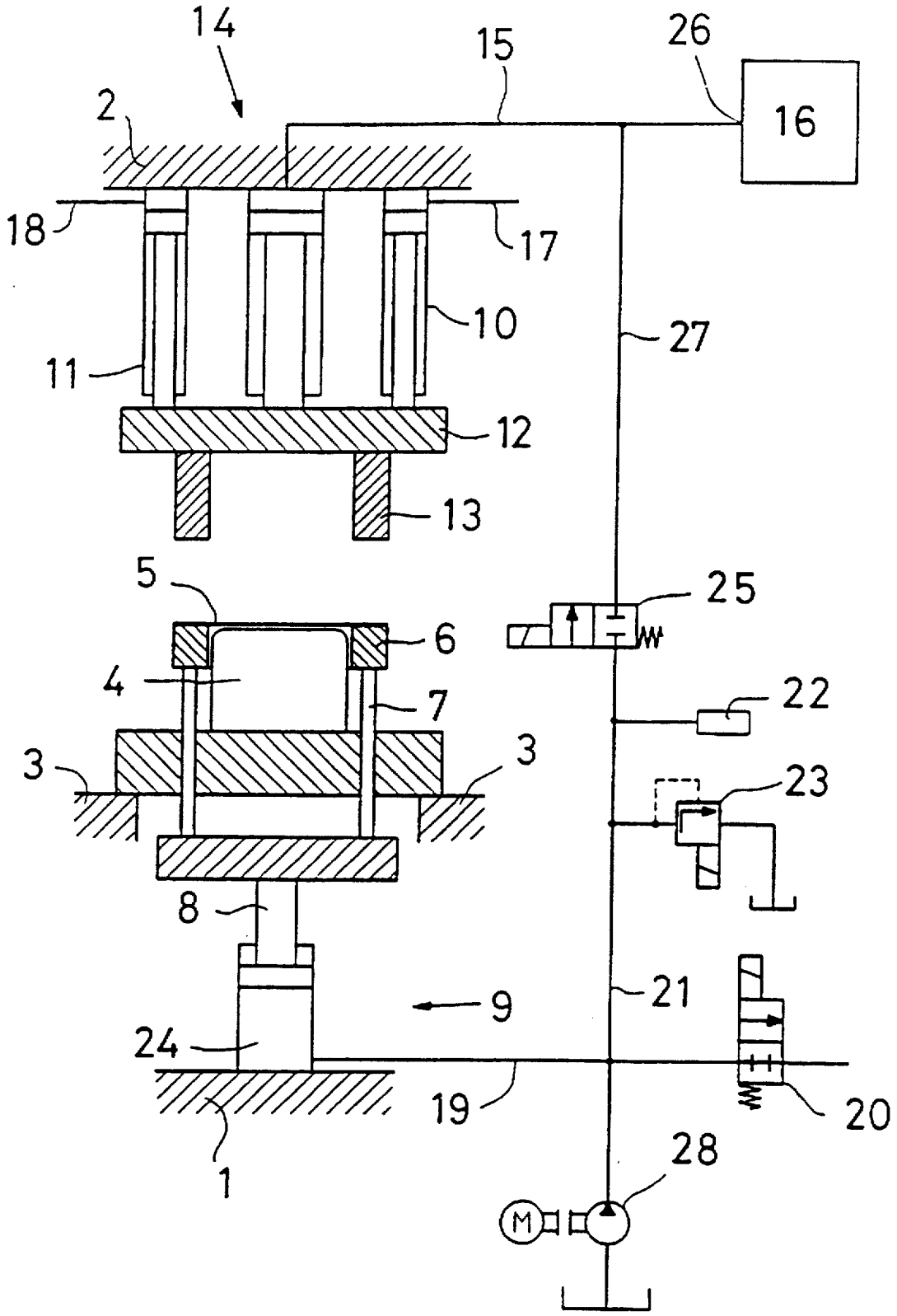

In FIG. 1, reference numerals 1 and 2 relate to the lower and upper portion, respectively, of the frame of a hydraulic press according to the invention. The frame further includes a table 3 on which rests a tool piece 4 over which a sheet metal blank 5 is to be formed. The sheet blank 5 rests on a locator ring 6 which, via a number of columns 7 or other suitable connecting devices, is connected to the piston rod or ram 8 in a locator cylinder or a lower clamping cylinder 9. The clamping cylinder is supported on the lower portion 1 of the frame and is thereby stationary.

It will be apparent from the described portion of the press that the lower clamping cylinder or the locator cylinder can manoeuvre the locator ring 6 in the vertical direction.

In the upper portion 2 of the frame of the press, there are disposed two working cylinders 10 and 11 whose downwardly directed piston rods or rams are connected to a slide 12 which, on its underside, carries a clamping ring 13 or second tool piece.

While not being apparent from the Drawings, the press according to the invention also includes suitable guides for guiding the slide 12 transversely of its direction of movement which, in the illustrated embodiment, is vertical.

Between the two working cylinders 10 and 11, there is disposed an upper clamping cylinder 14 whose purpose is to exercise a force against the slide 12, the force being intended to realise fixed clamping of the sheet metal blank 5 between the locator ring 6 and the clamping ring 13. Both of the working cylinders 10 and 11 are intended to generate a force against the slide 12, this force being adapted to accomplish the actual forming work on forming of the sheet blank 5 over the tool piece 4.

The upper clamping cylinder 14 is connected via a line 15 to a hydraulic system (not specified in detail on the Drawings) in the press. Correspondingly, both of the working cylinders 10 and 11 are connected via lines 17 and 18 to the hydraulic system 16.

The lower clamping cylinder 9 is connected via a line 19 to a valve 20 which, in turn, is connected to the hydraulic system 16. The line 19 is connected to a branch conduit 21 to which is connected a pressure sensor 22 and a pressure regulating throttle valve 23 which is controlled under the action of signals from the pressure sensor 22 and which discharges in the reservoir tank of the hydraulic system 16 for hydraulic fluid.

When the press illustrated in FIG. 1 is in operation according to conventional techniques, the valve 20 is opened and hydraulic fluid is fed via the line 19 to the lower clamping cylinder 9 so that the piston rod or ram 8 thereof is lifted to the position illustrated in FIG. 1. Hereafter, the valve 20 is closed so that the working volume 24 in the clamping cylinder is only in communication with its ambient surroundings via the pressure regulating throttle valve 23.

Once a sheet metal blank 5 has been placed on the locator ring 6, hydraulic fluid is fed to the working cylinders 10 and 11 and to the upper clamping cylinder 14 so that the slide 12 is moved in a downward direction under idling stroke movement. When the clamping ring 13 contacts with the sheet metal blank 5, the pressure rapidly increases in the system, a pressure also being built up in the working volume 24 of the lower clamping cylinder 9. When the pressure in this working volume has reached the value set at the pressure sensor 22, the sheet metal blank 5 is held fixedly clamped with a predetermined force. The movement of the slide 12 continues downwardly, whereafter the sheet metal material is drawn radially inwards between the clamping ring 13 and the locator ring 6 in order to be formed over the tool piece 4. At the same time, the locator ring 6 is forced downwards, which implies that the working volume 24 is reduced, for which reason hydraulic fluid is forced out through the pressure regulating valve 23. On this positive expulsion of hydraulic fluid, a large amount of work is throttled off through this valve.

When the work stroke has been completed, the slide 12 is lifted to the starting position according to FIG. 1, at the same time as the valve 20 is opened and hydraulic fluid is fed to the lower clamping cylinder 9 so that this returns to the position illustrated in FIG. 1, the finished sheet metal part being then lifted or stripped from the tool piece 4.

The line 21 which connects the lower clamping cylinder 9 with the pressure sensor 22 and the pressure regulator valve 23 is also in communication with a valve 25 which, in turn, is connected via a line 27 with the line 15 to the upper clamping cylinder 14. The line 15 is further provided with a connection 26 to the hydraulic system 16, this connection 26 being designed in such a manner that it can be blocked off and closed.

According to the present invention, the working volumes in both of the counter-directed clamping cylinders 9 and 14 are, at least during the forming phase proper, interconnected so that these together form a single, common volume of hydraulic fluid which can flow through the lines 15, 27, 21 and 19. This common volume of hydraulic fluid is kept discrete and blocked from the hydraulic system 16 at the connection 26 in that this connection is blocked off. In the same manner, the valve 20 is kept closed so that the connection is also blocked via this valve to the hydraulic system 16. As a result, the common volume is substantially enclosed and discrete from the rest of the hydraulic system.

In order to maintain a predetermined pressure in the common volume of hydraulic fluid for both of the clamping cylinders 9 and 14, a pressure maintenance device with a pump 28 is connected to the common volume, for example to the line 19. This pump is dimensioned for a slight flow and is only intended to generate a flow which is sufficient to compensate for any possible leakages and, in addition, a minor regulatory flow through the pressure regulator valve 23.

On execution of a working stroke according to the invention, the valve 25 is kept closed in the initial phase, while the valve 20 is opened so as to permit supply of hydraulic fluid to the lower clamping cylinder 9 so that this is returned to the position illustrated in FIG. 1. When this has taken place, the valve 20 is closed.

As an alternative possibility to lifting the locator ring 6 to the starting position according to FIG. 1, it might be mentioned that the pump 28 is started with large capacity at the same time as the valve 20 is kept closed. In this case, the pump 28 will, hence, realise return of the locator ring 6 to the starting position. Ideally, the pump 28 is, in this instance, designed with variable displacement, the maximum capacity of the pump being utilised during the return function.

Once a sheet blank 5 has been placed on the locator ring 6, hydraulic fluid is fed to the three cylinders 10, 11 and 14 connected to the slide 12 so that the slide 12 rapidly moves downwards until it comes into contact with the sheet metal blank 5. At this moment, the connection 26 is blocked at the same time as the valve 25 is opened and the valve 20 is closed if this has not already been happened earlier. Furthermore, the pump 28 is switched to slight flow.

Figure 2:
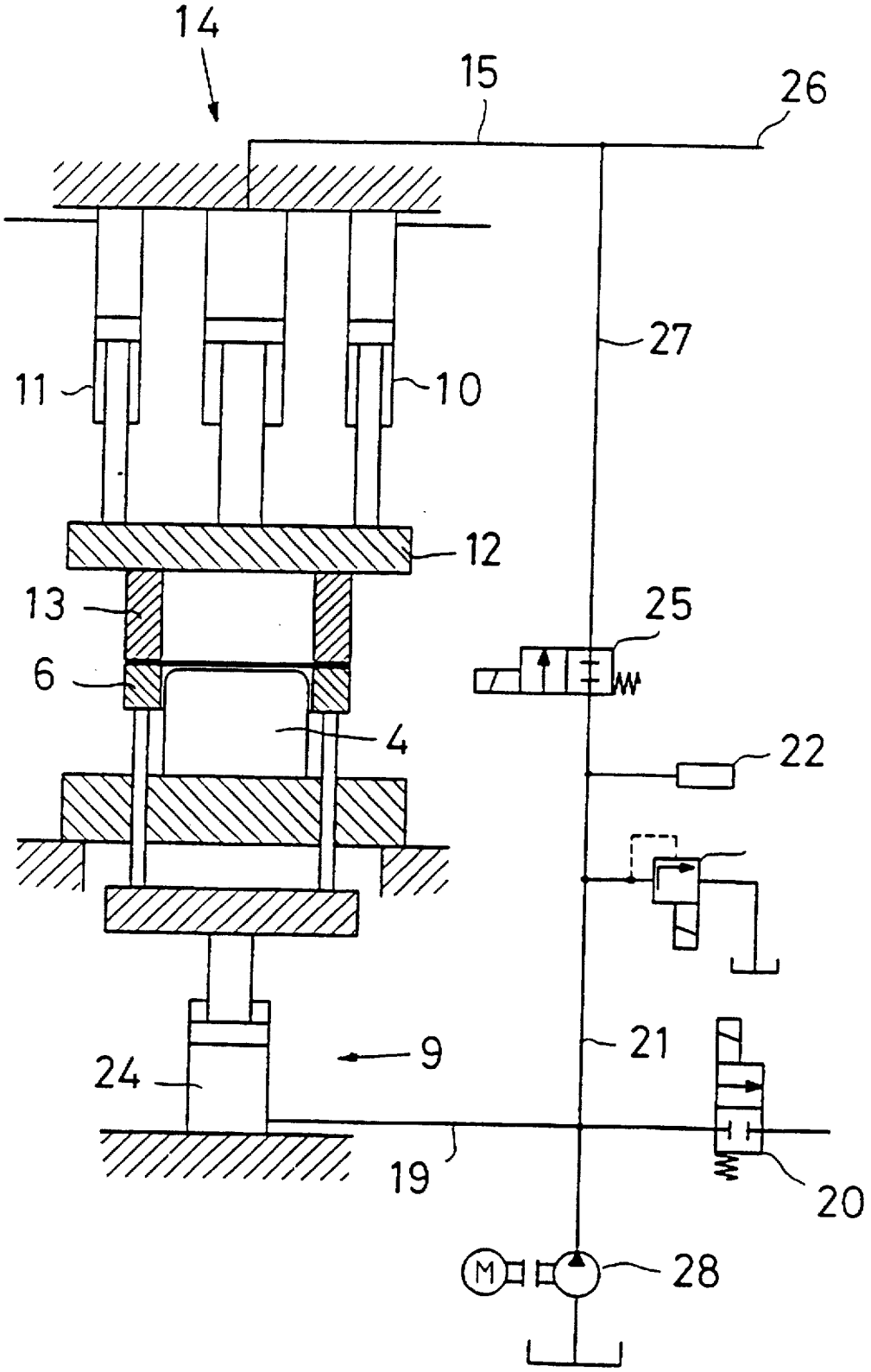

In the situation which has now arisen, and which is illustrated in FIG. 2, the working volumes in both of the counter-directed clamping cylinders 14 and 9 are interconnected with one another via the lines 15 and 27, the valve 25 and the lines 21 and 19. This common volume is discrete from the ambient surroundings and is placed under a predetermined pressure by the pressure maintenance device. When the forming phase proper is initiated by additional hydraulic fluid being supplied to the two working cylinders 10 and 11 from the hydraulic system 16, the locator ring 6 will be displaced in a downward direction, which results in hydraulic fluid flowing from the working volume of the lower clamping cylinder 9 via the lines 19 and 21, the valve 25 and the lines 27 and 15 up to the working volume in the upper clamping cylinder 14. No work, above and beyond the frictional work and flow losses, is accomplished during this movement.

In that the discrete common volume is held under a predetermined pressure under the action of the pressure maintenance device, the predetermined clamping force will simultaneously be maintained against the sheet metal blank 5.

The pressure maintenance device is designed in such a manner that it can supply, to the closed and common volume, a minor flow of hydraulic fluid, this flow being intended compensate for possible leakages and being intended to realise a pressure-regulating, slight flow through the pressure regulator valve 23.

Figure 3:
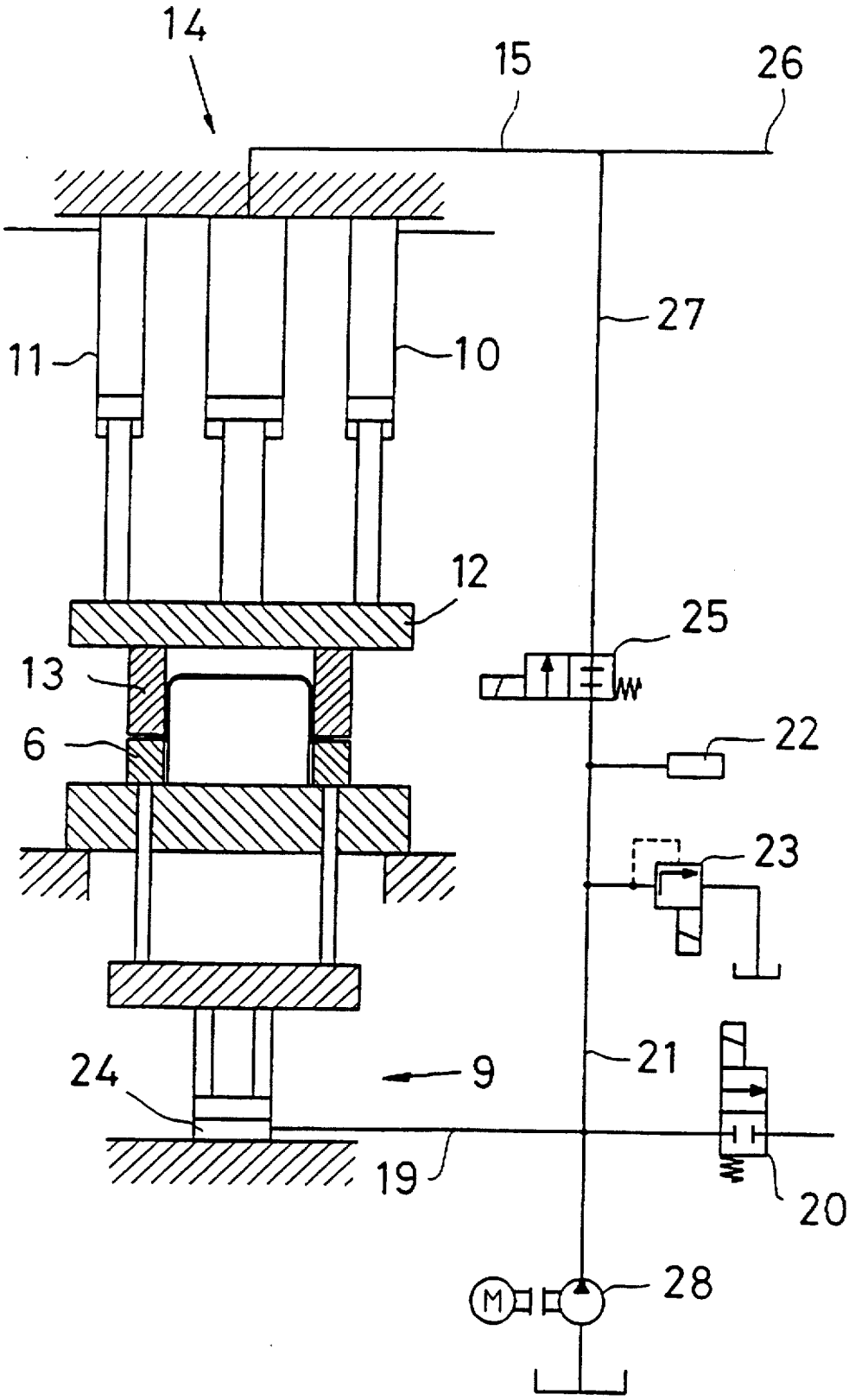

FIG. 3 shows the end position after a completed forming operation. In this position, the valve 25 is once again closed and the slide 12 is raised to the staring position according to FIG. 1. Thereafter (or possibly partially simultaneously with the lifting of the slide 12), hydraulic fluid is fed to the lower clamping cylinder 9 either through an increase of the flow from the pump 28 or through an opening of the valve 20 and supply from the hydraulic system 16. On lifting of the locator ring 6, the formed sheet blank is lifted from the tool piece 4 and the press returns to the starting position illustrated in FIG. 1.

In the above described embodiment, use is made of a pressure maintenance device with a pump 28 of variable displacement or variable flow. This device also includes the pressure regulator valve 23 and a pressure sensor 22 for controlling this valve. In this embodiment, it is also appropriate that the effective piston areas of both of the clamping cylinders 9 and 14 are of equal size. If a plurality of clamping cylinders operating in parallel with one another are employed, the sum total of their piston areas will be equal on both sides.

DESCRIPTION OF ALTERNATIVE EMBODIMENTS

In the foregoing, the pressure maintenance device has been described as including the pump 28. Since the flow which the pump 28 needs to generate during the forming phase proper is very limited, the pump can be replaced by a reservoir of hydraulic fluid, this reservoir being kept at a pressure which is equal to but preferably slightly greater than the pressure set at the pressure sensor 22. In such instance, the pressure in the reservoir may suitably be realised, possibly via a pressure converter, from a master pump included in the hydraulic system 16.

In yet a further alternative, that clamping cylinder which is compressed during the forming phase—the lower clamping cylinder 9 in the embodiment shown on the Drawings—may be of slightly larger piston area than the upper clamping cylinder 14. This entails that the volume of hydraulic fluid which, during the forming phase, is positively expelled from the lower clamping cylinder is greater than the volume of hydraulic fluid which is accommodated in the upper clamping cylinder 14. In this instance, the surplus can be adapted in such a manner as to compensate for possible leakages and, in addition, maintain the pressure-regulating flow through the pressure regulator valve 23. In this alternative, the pump 28 and the abovedescribed reservoir would, thus, be superfluous.

The present invention may be modified further without departing from the spirit and scope of the appended Claims.

What is claimed is:

1. An apparatus in a hydraulic press for deep drawing, comprising:

mutually reciprocating clamping members (6, 13) for fixedly clamping therebetween a sheet metal blank (5) with a predetermined force; at least two counter-directed clamping cylinders (9, 14) connected with, and operating, each respective clamping member; a tool piece (4) over which the sheet metal blank (5) is formed; and a power unit (10, 11, 16) which, for forming the sheet metal blank, is operative to realize a relative movement between, on the one hand, the tool piece (4), and, on the other hand, the clamping members (6, 13), characterized in that the working volumes of the clamping cylinders (9, 14), at least during the forming phase proper, are interconnectable to a common volume; and that a pressure maintenance device (22, 23, 28) is coupled to this volume for realising the predetermined clamping force.

2. The apparatus as claimed in claim 1, characterized in that the total areas of the clamping cylinders (9, 14) which acts on each clamping member (6 and 13, respectively) are substantially equal.

3. The apparatus as claimed in claim 1, characterized in that the pressure maintenance device includes a pump (28) or a reservoir which is connected to the common volume for compensating for hydraulic fluid leakage therefrom.

4. The apparatus as claimed in claim 1, characterized in that the pressure maintenance device includes a pressure regulator valve (23) which, at least during the forming phase proper, is operative to permit a certain flow or leakage out from the common volume.

5. The apparatus as claimed in claim 1, characterized in that the pump (28) or the reservoir is provided exclusively for pressure maintenance of the common volume.

6. The apparatus as claimed in claim 2, characterized in that the pressure maintenance device includes a pump (28) or a reservoir which is connected to the common volume for compensating for hydraulic fluid leakage therefrom.

7. The apparatus as claimed in claim 2, characterized in that the pressure maintenance device includes a pressure regulator valve (23) which, at least during the forming phase proper, is operative to permit a certain flow or leakage out from the common volume.

8. The apparatus as claimed claim 3, characterized in that the pump (28) is of variable displacement.

9. The apparatus as claimed in claim 3, characterized in that the flow from the pump (28) is, at least during the forming phase proper, slight in relation to the flow from a hydraulic pump included in the power unit (10, 11, 16).

10. The apparatus as claimed in claim 3, characterized in that the pressure maintenance device includes a pressure regulator valve (23) which, at least during the forming phase proper, is operative to permit a certain flow or leakage out from the common volume.

11. The apparatus as claimed in claim 4, characterized in that the pump (28) or the reservoir is provided exclusively for pressure maintenance of the common volume.

12. The apparatus as claimed in claim 4, characterized in that the pump (28) is of variable displacement.

13. The apparatus as claimed in claim 4, characterized in that the flow from the pump (28) is, at least during the forming phase proper, slight in relation to the flow from a hydraulic pump included in the power unit (10, 11, 16).

14. The apparatus as claimed in claim 5, characterized in that the pump (28) is of variable displacement.

15. The apparatus as claimed in claim 5, characterized in that the flow from the pump (28) is, at least during the forming phase proper, slight in relation to the flow from a hydraulic pump included in the power unit (10, 11, 16).

16. The apparatus as claimed in claim 8, characterized in that the flow from the pump (28) is, at least during the forming phase proper, slight in relation to the flow from a hydraulic pump included in the power unit (10, 11, 16).

17. A hydraulic press comprising:

first and second clamping members for fixedly clamping a sheet metal blank between the first and second clamping members with a predetermined force;

first and second counter-directed clamping cylinders operatively connected to the first and second clamping members, respectively;

a tool piece;

a power unit for forming a sheet metal blank on the tool piece, the power unit operative to provide relative movement between the tool piece and the clamping members;

a common volume;

the clamping cylinders each having a working volume interconnectable to the common volume; and a pressure maintenance device coupled to the common volume for maintaining a predefined pressure on the working volumes via the common volume for controlling the application of the predetermined force.

18. A hydraulic press comprising:

first and second clamping members for fixedly clamping a sheet metal blank between the first and second clamping members with a predetermined force;

first and second counter-directed clamping cylinders each having a working volume and operatively connected to the first and second clamping members, respectively;

a tool piece;

a power unit for forming the sheet metal blank on the tool piece, the power unit operative to provide relative movement between the tool piece and the clamping members;

a connecting arrangement interconnecting the working volumes of the first and second clamping cylinders to one another for allowing hydraulic fluid exhausted from one of the first and second clamping cylinders to enter the other one of the second and first clamping cylinders, respectively;

said working volume and said connecting arrangement forming a substantially closed common volume; and a pressure maintenance device coupled to the common volume for maintaining a predetermined pressure on the working volumes for controlling the predetermined force.

19. A hydraulic press comprising:

first and second clamping members for fixedly clamping a sheet metal blank between the first and second clamping members with a predetermined force;

first and second counter-directed clamping cylinders operatively connected to the first and second clamping members, respectively;

a tool piece;

a power unit for forming a sheet metal blank on the tool piece, the power unit operative to provide relative movement between the tool piece and the clamping members;

the clamping cylinders each having a working volume interconnectable to one another via a connection means allowing a substantially un-restricted flow of fluid therethrough; and a pressure maintenance device coupled to the connection means or the work volumes for maintaining a predefined pressure on the working volumes for controlling the application of the predetermined force.

20. A hydraulic press comprising:

first and second clamping members for fixedly clamping a sheet metal blank between the first and second clamping members with a predetermined force;

first and second counter-directed clamping cylinders operatively connected to the first and second clamping members, respectively, said clamping cylinders each having a cylinder bore and a working volume, the cylinder bore of the first and second clamping cylinders having substantially identical dimensions;

a tool piece;

a power unit for forming the sheet metal blank on the tool piece, the power unit operative to provide relative movement between the tool piece and the clamping members;

a connecting arrangement interconnecting the working volumes of the first and second clamping cylinders for allowing hydraulic fluid exhausted from one of the first and second clamping cylinders to enter the other one of the second and first clamping cylinders, respectively, and said working volumes and said interconnecting arrangement forming a substantially closed common volume;

a source of pressurized hydraulic fluid connected to the common volume; and a pressure regulating valve connected to the common volume for allowing a small pressure regulating flow of hydraulic fluid through the regulating valve.

21. A hydraulic press comprising:

first and second clamping members for fixedly clamping a sheet metal blank between the first and second clamping members with a predetermined force;

first and second counter-directed clamping cylinders each having a bore and a working volume and operatively connected to the first and second clamping members, respectively;

a tool piece;

a power unit for forming the sheet metal blank on the tool piece, the power unit operative to provide relative movement between the tool piece and the clamping member, one of the clamping cylinders being counter directed to the power unit;

a connecting arrangement interconnecting the working volumes of the first and second clamping cylinders, the clamping cylinder counter directed to the power unit having a bore larger than the bore of the other clamping cylinder, thereby creating a small output flow in excess of the flow received by the other clamping cylinder; and a pressure regulating valve connected to the common volume releasing an output flow.

22. Method for performing a pressing operation, comprising:

clamping a sheet metal blank between first and second clamping members by supplying a pressurized fluid to first and second clamping cylinders operationally connected to the first and second clamping members, respectively;

moving the blank and a tool piece towards one another and forming the blank on the tool piece; and forming a common volume by hydraulically connecting the first and second clamping cylinders and allowing a flow of fluid exhausted from one of the clamping cylinders to be received in the other clamping cylinder while maintaining the pressure of the fluid at a predetermined level, thereby clamping the blank between the clamping members with a predetermined force.

23. Method for performing a pressing operating, comprising:

clamping a sheet metal blank between first and second clamping members by supplying a pressurized fluid to first and second clamping cylinders operationally connected to the first and second clamping members, respectively;

moving the blank and a tool piece relative to one another and forming the blank on the tool piece;

forming a common volume by hydraulically connecting the first and second clamping cylinders and allowing a flow of fluid exhausted from one of the clamping cylinders to be received in the other clamping cylinder;

supplying a first flow of pressurized fluid to the hydraulically connecting clamping cylinders, and;

regulating the pressure of the fluid by allowing a second flow of fluid out from the hydraulically connected clamping cylinders through a pressure regulating valve.

* * * * *